US011650020B2

(12) United States Patent
Tirri

(10) Patent No.: US 11,650,020 B2
(45) Date of Patent: May 16, 2023

(54) GUN WITH A DELAY FUNCTION

(71) Applicant: Ari-Matti Tirri, Herrala (FI)

(72) Inventor: Ari-Matti Tirri, Herrala (FI)

( * ) Notice: Subject to any disclaimer, the term of this patent is extended or adjusted under 35 U.S.C. 154(b) by 0 days.

(21) Appl. No.: 17/513,155

(22) Filed: Oct. 28, 2021

(65) Prior Publication Data

US 2022/0136786 A1 May 5, 2022

(30) Foreign Application Priority Data

Oct. 29, 2020 (FI) ..... 20207176

(51) Int. Cl.
*F41A 3/62* (2006.01)
*F41A 3/46* (2006.01)

(52) U.S. Cl.
CPC . *F41A 3/62* (2013.01); *F41A 3/46* (2013.01)

(58) Field of Classification Search
CPC ..... F41A 3/42; F41A 3/62; F41A 5/34; F41A 5/36
USPC ..... 89/191.01, 191.02, 192
See application file for complete search history.

(56) References Cited

U.S. PATENT DOCUMENTS 1,010,899 A * 12/1911 Halle ..... F41A 5/18 89/193
3,261,264 A * 7/1966 Wilson ..... F41A 3/62 89/193
3,776,096 A * 12/1973 Donovan ..... F41A 3/26 89/142
4,580,484 A * 4/1986 Moore ..... F41A 5/18 89/187.02
5,886,281 A * 3/1999 Kirstein ..... F41A 5/18 89/187.01
6,619,592 B2 * 9/2003 Vignaroli ..... F41A 5/18 89/193
8,272,314 B1 * 9/2012 Gould ..... F41A 5/26 89/191.01

(Continued)

*Primary Examiner* — Bret Hayes
(74) *Attorney, Agent, or Firm* — Johnson and Phung LLC; Thomas N. Phung

(57) ABSTRACT

Delayed action magazine-based self-loading firearm with gas piston action. Delay action prevents the movement of the self-loading firearm's slide and lock during the actual shot and will keep them closed. The construction of the delayed action stores the energy from the powder gas either mechanically or pneumatically, to be used later for the operation of the firearm's load-lock mechanism. The delayed action mechanism of a delayed action firearm consists of the body (E) and a guide (C) with its openings (D) placed inside it, through which the high-pressure powder gas escapes through the firearm's barrel (A) onward to the gas piston (F), which moves pierced by a pole (H), with the pole (H) being attached to the bottom piece (I). A spring (G) may be connected to the pole (H), with the pressure of the powder gas compressing either the spring (G) or alternatively the air by the gas piston (F) against the bottom piece (I). The retainer (K) stops the gas piston (F) into its back position leaving the spring (G) or air into compression. Through the action of the shooter or a separate automatic mechanism on the releaser (M) the bottom piece (I) is allowed to dash backwards with the help of the spring (G) or air. The bottom piece (I) is fixed to the firearm's slide (O), which uses the firearm's load and lock mechanism to perform the cartridge case removal and loading actions.

3 Claims, 2 Drawing Sheets

(56) References Cited

U.S. PATENT DOCUMENTS

Figure 1:
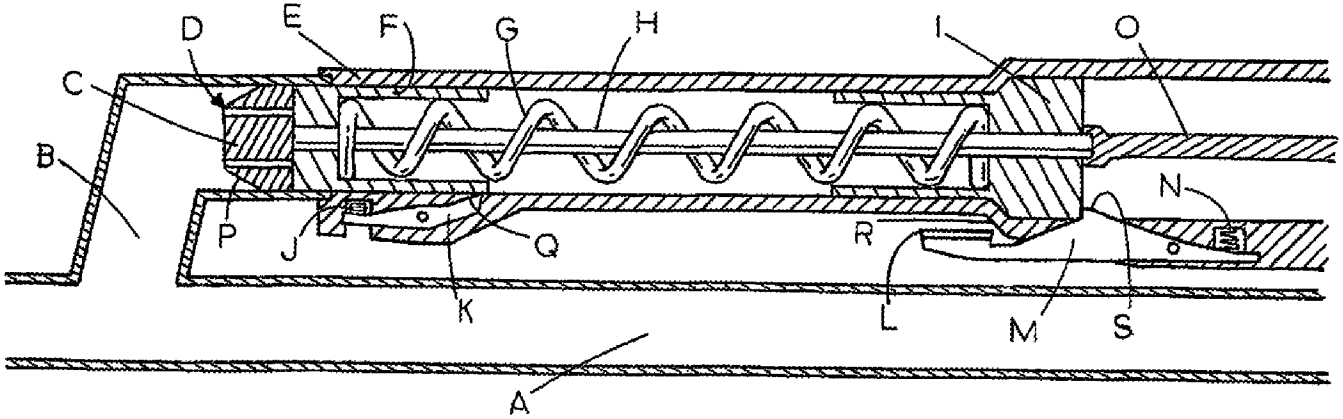

| | | | | |
|---|---|---|---|---|
| 2010/0224056 | A1* | 9/2010 | Monroe | F41A 3/62<br>89/193 |
| 2010/0282065 | A1* | 11/2010 | Stone | F41A 5/28<br>89/191.02 |
| 2021/0116190 | A1* | 4/2021 | Craig | F41A 3/54 |
| 2022/0099392 | A1* | 3/2022 | Puha | F41A 3/54 |

* cited by examiner

GUN WITH A DELAY FUNCTION

FIELD OF INVENTION

The invention is related to weapons technology. The object of the invention is a loading mechanism of a self-loading gas piston action firearm, specifically the removal of the used cartridge from the cartridge chamber and the feeding of a new cartridge into the cartridge chamber, and especially the timing control of this action.

BACKGROUND OF THE INVENTION

A self-loading gas piston action firearm with a magazine creates the required energy for activation from the powder gas of the fired cartridge. This very hot and high-pressure gas is partially directed through a hole made into the barrel of the firearm into the gas piston placed inside a cylinder. The force thus achieved from the powder gas pushes the gas piston backwards. This force is further transferred to the slide and lock, which while retreating open up thus enabling the fired cartridge attached to the lock to be removed from the cartridge chamber. However, at the same time hot and soot forming powder gas will be discharged into the inner parts of the gun through the opening slide and lock. With the help of the force of the return spring the lock and slide will return back to the forward position while at the same time taking a new cartridge from the clip or magazine into the cartridge chamber thus enabling the firing of the firearm again. This chain of events occurs in a fraction of a second without the shooter having a chance to influence it after firing the shot.

The British patent GB 147371 A defines a structure, in which a part of the force from the powder gas is directed directly from the cartridge chamber through the cartridge through a channel onto a piston, which compresses two consecutive air cylinders pressing the air in them to a higher pressure. The air cylinder in the front acts in the said invention as a shock absorber and returns immediately after the powder gas pressure eases back with the help of the air it has compressed.

The air cylinder in the back locks via a lever while being compressed and the complete automatically compressed piston-cylinder assembly moves backward with the help of the air cylinder in the front while at the same time, with the help of a rod connected permanently to the cylinder in the back, achieves the backward movement required for the lock and close mechanism operation. After reaching the back position the locking of the rear end air cylinder will be automatically released and the compressed air of the rear end air cylinder will return the moving parts of the load and lock mechanism and the entire assembly forward into its starting position to wait for the next shot.

The same British patent GB 147371 A also describes a spring action version of the described system. Also, in that version the powder gas force is directed directly from the cartridge chamber through the cartridge through a channel into the piston, which compresses the nested piston-cylinder assembly thus overcoming the force of the two separate springs inside. The assembly will lock automatically during compression with the help of a lever and one of the two springs will push the compressed assembly backwards immediately after the powder gas pressure is relieved thus acting as a sort of shock absorber. The backward directed movement of this assembly is transferred with the help of a rod attached to the assembly to the load and lock mechanism of the firearm to be used in the way the firearm construction demands. After plunging into the back position, the containment lever of the piston-cylinder assembly will automatically release the piston and cylinder from each other and one of the said springs is thus freed to push the assembly into its starting position while at the same time carrying via the rod the firearm mechanism into the forward, i.e. starting, position thus completing the actions required by the load and lock mechanism before the next shot.

THE INTENTION OF THE INVENTION

In a delayed action self-loading gas-piston firearm with a magazine the slide and bolt remain in place after the shot has been fired. They are released to plunge backwards only after the shooter has so decided or automatically with a delay in such a way, however, that the fired bullet has cleared out of the barrel of the firearm and after the powder gas pressure has been completely released from the barrel.

By using such an arrangement, a benefit compared to conventional self-loading firearms is achieved in that the moving parts of the firearm are prevented from jerking the firearm during the shot while the mechanism is starting to move, when it reaches the back position, when it plunges forward or when it reaches the forward position, thus increasing the accuracy of the firearm. The delayed action will pacify the firing moment of accuracy demanding shots by making it similar to single-action, i.e. bolt action, firearm firing. The benefit compared to a single-action firearm is that the shooter does not need to dismount the firing posture to load the firearm manually and that a new shot can be fired faster.

In addition, the firing mechanism of a delayed action firearm will remain cleaner and cooler than that of a traditional self-loading firearm, because the lock which remains closed and the slide which remains in position during the shot will not allow hot soot forming powder gas into the mechanisms of the firearm contrary to traditional self-loading firearms. This feature is enhanced when using a silencer with the firearm, in which case the release of the powder gases backwards towards the firearms mechanism is accentuated.

A delayed action firearm will give the fired bullet a higher exit velocity due to the fact that the force of the powder gases is not allowed to discharge in unwanted directions, as would be the case with traditional self-loading firearms. This increases the accuracy of the firearm and the power of the bullet.

The safety of use of a delayed action firearm is better compared to a traditional self-loading firearm with a magazine when used with a reload timing controlled by the shooter. This is due to the fact that with a delayed action firearm the fired empty cartridge remains in the cartridge chamber thus preventing accidental firing if the firearm remains or is left without the safety on after the shot.

To achieve these goals characteristic of the invention is what is presented in the characterizing part of the enclosed patent claim 1.

EXPLANATION OF THE INVENTION

The powder gases from the shot cartridge in a delayed action firearm are directed through a gas port machined into the firearms barrel and through that into a cylinder like tube which may contain a spring-loaded gas piston. A rod extends through the gas piston with a guide at the end which receives the gases from the barrel, the guide containing machined holes through which the powder gas pressure can move to the gas piston. A bottom piece is located at the opposite end of the rod, to which the rod is fixed and on which a possible gas piston spring rest. This bottom piece is connected to the slide of the firearm. In addition, the firearm contains a spring-loaded retainer and releaser.

The powder gas pressure enters the cylinder like tube from the barrel via the gas port, continues through holes machined into the guide on to the gas piston, which due to the powder gas pressure moves backwards and simultaneously presses the spring or air against the bottom piece. The gas piston while moving backwards locks into the back position as the retainer's retaining claw grips on to the front edge of the gas piston.

The release keeps the bottom piece in place with its retaining claw. As the shooter releases the bottom piece with the release lever attached to the releaser or by a possibly used automatic delayed action mechanism operating the said releaser, the bottom piece will lunge backwards by the force of the compressed spring or air and make the firearm slide and lock move backwards as in the case of conventional self-loading firearms. In such cases the shot cartridge can be removed from the cartridge chamber and from the firearm and the firearm will be loaded again. The releaser lever can be also attached to the firearm trigger movement. Delayed action can be applied both to long and short strike firearms.

In a spring-loaded mechanism an air channel can also be machined, which leads into the intermediate space between the gas piston and bottom piece. This solution reduces the pressure differences in the interim space between the gas piston and bottom piece compared to ambient air pressure. These pressure differences are created by the movement of the gas piston and the bottom piece relative to each other. This air channel eases the operation of the spring in case the dimensional ratio of the parts so requires.

The return spring of the firearm returns the moving parts of the firearm back into the forward i.e. starting position while taking a new cartridge out of the clip or magazine into the cartridge chamber to make the firearm ready for a new firing. At the same time, the return spring of the firearm returns the delayed action mechanism parts into the forward i.e. starting position. The machined skewed surfaces will make the retainer and releaser claws move to the side while returning to the starting position.

Keeping the releaser opened up during firing makes the delayed-action firearm work without delay, similar to a conventional self-loading firearm. On the other hand, the assembly can be manufactured in reverse so that a delayed-action firearm will work as a traditional self-loading firearm without a delay action, and only by separately activating the releaser the firearm will work using the delayed action. The construction also makes it possible to use a separate selector to choose which function is used.

A mechanical spring may be replaced with a pneumatic system, in which air instead of a spring is compressed to store energy.

Characteristic to the invention is that the energy from the powder gas is stored and that this energy is available later to activate the load and lock mechanism of the firearm either at a moment chosen by the shooter, or controlled by an automatic delay action, however, with the limitation that the bullet and the powder gas pressure have already exited the firearms barrel.

To achieve these goals characteristic of the invention is what is presented in the characterizing part of the enclosed patent claim 1.

LIST OF FIGURES

Figure 2:
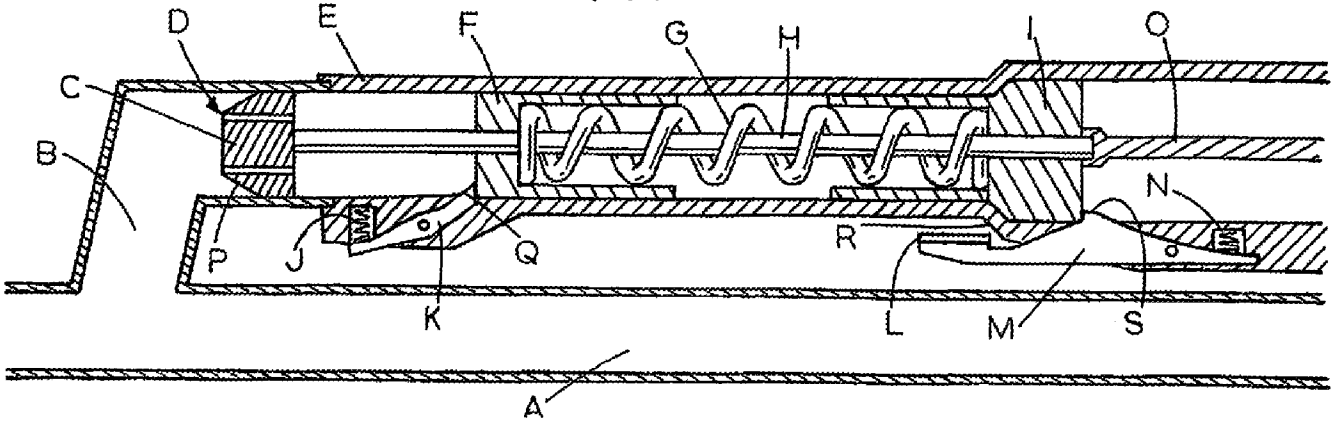
Figure 3:
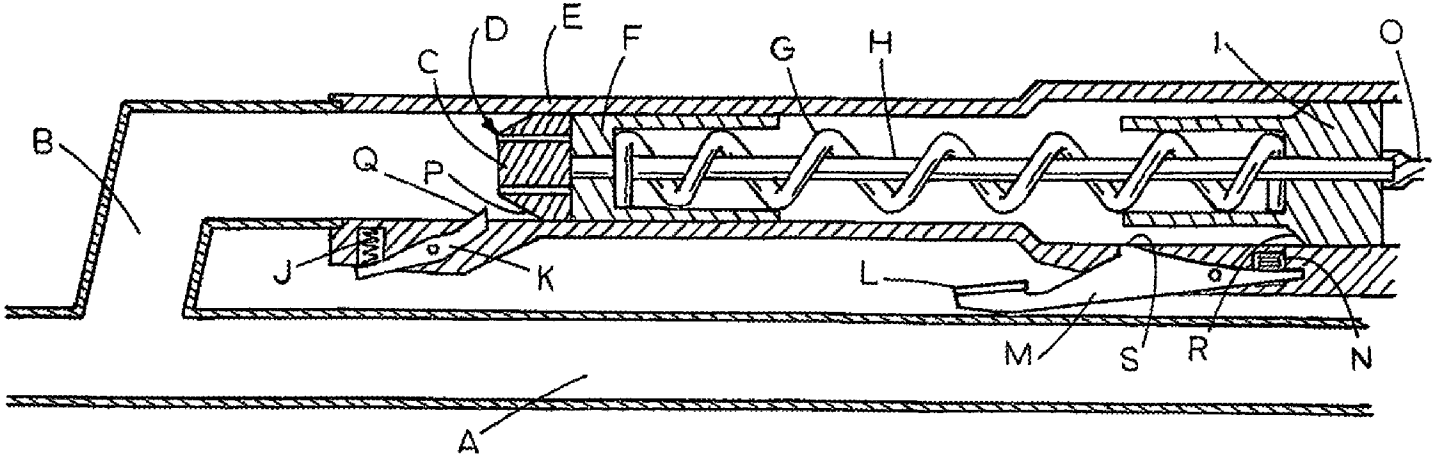

What follows is a detailed description of the invention using references to the attached figures, in which FIG. 1 depicts the delayed action mechanism in the starting position before a shot is fired, FIG. 2 depicts the delayed action mechanism after a shot has been fired with the energy in this case being stored into a spring, FIG. 3 depicts the delayed action mechanism while reloading utilizing the energy stored into the spring.

The figures are side views and presented as cross-sections.

DETAILED DESCRIPTION OF THE INVENTION

The following is one possible execution option of a delayed action firearm delay mechanism.

FIG. 1

After the firearm has been fired the bullet passes the gas port (B) opening located in the barrel (A), through which very hot and high-pressure gas is allowed to be discharged through machined gas ports (D) on the guide (C) onward to the gas piston (F) inside the body (E).

FIG. 2

The gas will make the gas piston (F) pierced by a rod (H) lunge backwards pressing the spring (G) against the bottom piece (I). The gas piston (F) will lock into the backward position arrested by the retainer (K). The retainer (K) is operated by spring (J).

FIG. 3

The shooter will use the release lever (L), which moves the releaser (M), loaded by the spring (N). The claw of the releaser (M) will release the bottom piece (I), which is connected using a stiff joint to the slide (O) of the firearm. The force of the compressed spring (G) will make the bottom piece (I), rod (H) and guide (C), connected to it using a stiff joint, and the slide (O) of the firearm lunge backwards enabling the removal of the spent cartridge from the cartridge chamber and from the firearm and the reloading of a new cartridge from a clip or magazine into the cartridge chamber. The guide (C) will also take along with it the gas piston (F) while lunging backwards.

The return spring pushes the moving parts of the firearm back to the forward position and the delay mechanism will return into a position described in FIG. 1 to wait for the next shot by the same return spring. The skewed surfaces of the delay mechanism (P, Q, R, S) will make the retainer (K) and releaser (M) move aside out of the way of the guide (C), gas piston (F) and bottom piece (I), after which the retainer (K) and releaser (M) return to a state shown in FIG. 1 with the force from springs (J, N). It is possible to carry out the realization economically also without separate springs (J, N) with the retainer (K) and releaser (M) body acting as a spring-like elastic element attached to the body (E).

The invention claimed is:

1. A delayed action firearm consisting of:

a body containing a guide with a plurality of openings;

a connected rod penetrating a gas piston attached to a bottom piece;

a retainer adjoined to the firearm, a releaser and a set of springs designed to operate the retainer and releaser;

the bottom piece connected to a firearm slide, with a powder gas energy being stored either into a spring or air being squeezed between the gas piston and the bottom piece, and from which an energy at a later selected moment is directed via the bottom piece to the firearm slide.

2. The delayed action firearm of claim 1 wherein after firing of a shot the powder gas energy is stored to prevent the firearm slide from moving before a time set or adjusted by a shooter.

3. The delayed action firearm of claim 1 wherein a delayed action is switched on separately the firearm otherwise functioning without a delay function.

* * * * *